United States Patent [19]

de Mos et al.

[11] 4,057,226

[45] Nov. 8, 1977

[54] MIXING DEVICE

[75] Inventors: Jacob Mink de Mos, Warnsveld; Pieter Koek, Eefde, both of Netherlands

[73] Assignee: N.V. Machinefabriek Terlet, Zutphen, Netherlands

[21] Appl. No.: 427,553

[22] Filed: Dec. 26, 1973

[30] Foreign Application Priority Data

Aug. 29, 1973 Netherlands ..... 7311901

[51] Int. Cl.[2] ..... B01F 7/00

[52] U.S. Cl. ..... 366/244; 366/287

[58] Field of Search ..... 259/72, 83, DIG. 42, 259/1 R, 99, 111, 100, 5, 19, 21, 37, 40, 64, 102, 116, 118; 68/152, 102, 15

[56] References Cited

U.S. PATENT DOCUMENTS

| | | | |
|---|---|---|---|
| 59,325 | 10/1866 | Wathew | 259/72 X |
| 227,396 | 5/1880 | Tregurtha | 259/102 |
| 1,248,327 | 11/1917 | Hoerburger | 259/99 |
| 1,475,978 | 12/1923 | Westerman | 259/102 |
| 2,215,288 | 9/1940 | Hays | 259/99 X |
| 2,529,650 | 11/1950 | Davis | 259/111 X |
| 2,736,535 | 2/1956 | Clark | 259/102 |
| 2,995,917 | 8/1961 | Altorfer | 68/15 |
| 3,120,948 | 2/1964 | Stratienko | 259/111 |
| 3,201,094 | 8/1965 | Ligon | 259/64 |
| 3,315,947 | 4/1967 | Nauta | 259/111 |
| 3,339,896 | 9/1967 | McKibben | 259/72 |
| 3,345,043 | 10/1967 | Bovagne | 259/102 |
| 3,436,058 | 4/1969 | Murphy | 259/99 |
| 3,659,826 | 5/1972 | Nauta | 259/102 |
| 3,861,656 | 1/1975 | Schmitt | 259/118 |

*Primary Examiner*—Harvey C. Hornsby
*Assistant Examiner*—Robert Pous
*Attorney, Agent, or Firm*—Snyder, Brown & Ramik

[57] ABSTRACT

A mixing device comprising a vessel and an agitator extending into the vessel in which the vessel is hermetically sealed from the atmosphere by a flexible member detachably connected with the wall and the agitator shaft. Means are provided to maintain the agitator shaft in a fixed angular position during the stirring operation.

1 Claim, 7 Drawing Figures

MIXING DEVICE

The invention relates to a mixing device comprising a vessel and an agitator extending into the vessel and formed by an approximately vertical shaft and approximately radially extending blades, said agitator being eccentrically journalled in the vessel and being such that it describes a closed path.

If in such a generally known mixing device foodstuffs, for example, porridge, yogurt and the like have to be mixed, the vessel has to be hermetically sealed from the atmosphere in order for the contents of the vessel to remain as sterile as possible. Hitherto agitators adapted to rotate about the shaft are employed, which are sealed as much as possible from the closing lid of the vessel. For this purpose a stuffing box may be used.

Practice has learned, however, that the seal thus obtained is not complete and that bacteria may penetrate into the contents of the vessel with their harmful effect on the quality thereof.

The invention has for its object to provide a mixing device which can be hermetically closed from the atmosphere. In accordance with the invention this is achieved by sealing the vessel with the aid of a flexible member detachably connected with the wall and the agitator shaft, whilst means are provided for holding the shaft of the agitator in a fixed angular position. By causing the agitator shaft not to rotate about its centre line, the sealing member can be fixedly connected with the agitator shaft and hence in a hermetically sealed manner.

The means for holding the agitator shaft in a fixed angular position are formed by a planetary driving gear comprising a housing carrying the agitator shaft along and a planetary wheel fixedly secured to the agitator shaft and rolling along a second planetary wheel engaging a sun-wheel. It is thus ensured that during the circular movement performed by the housing and hence by the agitator shaft the latter is rotated by the first planetary wheel with respect to the housing. By providing the wheels of the driving gear with the same number of teeth, the angular position of the agitator shaft will remain constant.

The agitator shaft is preferably arranged in an inclined position so that during the mixing operation substantially the whole vessel is worked by the agitator blades. The seal may be formed by a bellows or a skin of a synthetic resin or rubber.

There may also be designed an embodiment in which the agitator shaft is freely rotatable in a rotating arm. In this case the sealing member should have such a resistance against torsional forces that the agitator shaft is not rotated by the resistance exerted by the contents of the vessel.

The seal is connected with the agitator shaft preferably approximately at the point of intersection of the agitator shaft and the centre line of the vessel.

In a variant of the invention the means for maintaining a fixed angular relationship are formed by a guide path for the agitator shaft adapted to turn about a horizontal pivotal shaft. In this case the agitator shaft can perform a movement in two co-ordinate senses, the shaft being guided in one sense by the guide path and in the other direction at right angles to the former by the pivotal movement about the horizontal axis of the guide path. The agitator shaft can be secured against rotation by guide rollers connected to the agitator shaft and co-operating with the guide path. As an alternative, rotational blocking may be ensured by providing the agitator shaft with a flat part engaging the guide path. The agitator shaft can be driven by accommodating it in a freely rotatable manner in a sleeve driven eccentrically with respect to the vessel.

As a further alternative rotation of the agitator member may be prevented by arranging the agitator blades so as to be freely rotatable with respect to the agitator shaft such that no torque will be exerted on the agitator shaft.

The invention will be described more fully with reference to the accompanying drawings.

Figure 3:
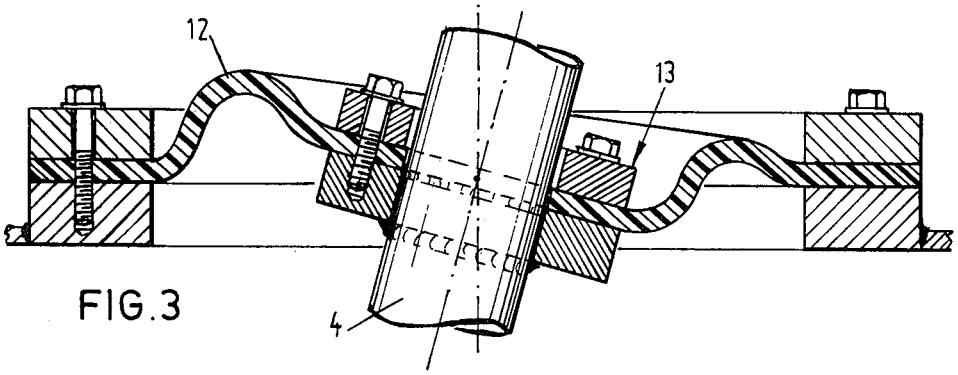
FIG. 3 shows one embodiment of a sealing member.
Figure 1:
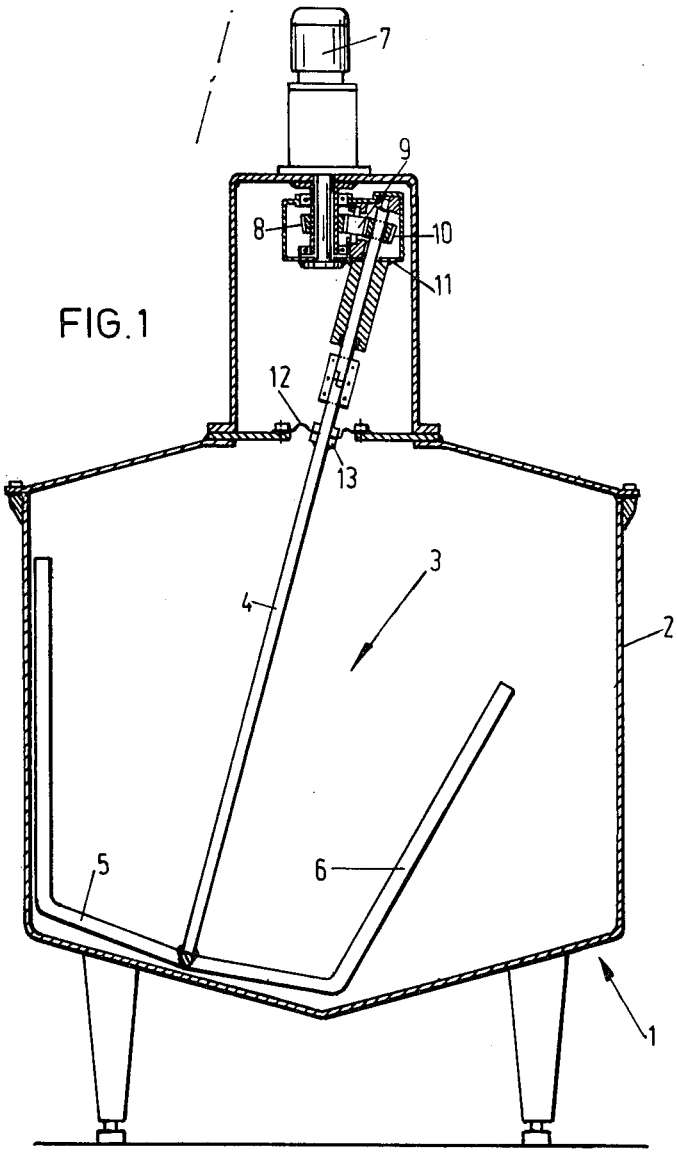
FIG. 1 is a sectional view of a mixing device in accordance with the invention.

The mixing device 1 comprises a vessel 2 and an agitator 3 extending in the vessel and formed by an agitator shaft 4 and radially extending agitator blades 5 and 6. The agitator shaft 4 is journalled at the top end eccentrically to the centre line of the vessel. The agitator is driven by an electric motor 7, which drives the planetary gear formed by the bevel gear wheel 8, the planetary bevel gear wheels 9 and 10 and the housing 11. The electric motor rotates the housing 11 via the sleeve 12. Since the agitator shaft is journalled in the housing 11, it will describe a closed path. During this movement the planetary wheel 10 rolls along the planetary wheel 9, which in turn rolls along the stationary sun wheel 8.

By choosing equal numbers of teeth of said wheels, the agitator shaft 4 is subject to such an angular displacement with respect to the housing 11 during the rotation of the housing 11, that the angular position with respect to the vessel remains constant. The seal is formed by a sealing film 12 of flexible material, for example, rubber or a synthetic resin fixedly connected with the vessel wall and the agitator shaft 4. The angular position of the agitator shaft 4 remains also constant relative to the sealing film 12. By securing the sealing film 12 approximately at the point of intersection of the agitator shaft 4 and the centre line of the vessel 2, the agitator shaft only performs a swinging motion around said fastening point without performing a rotation. The sealing film 12 may be connected with the agitator shaft 4 with the interposition of a flange 13.

Figure 2:
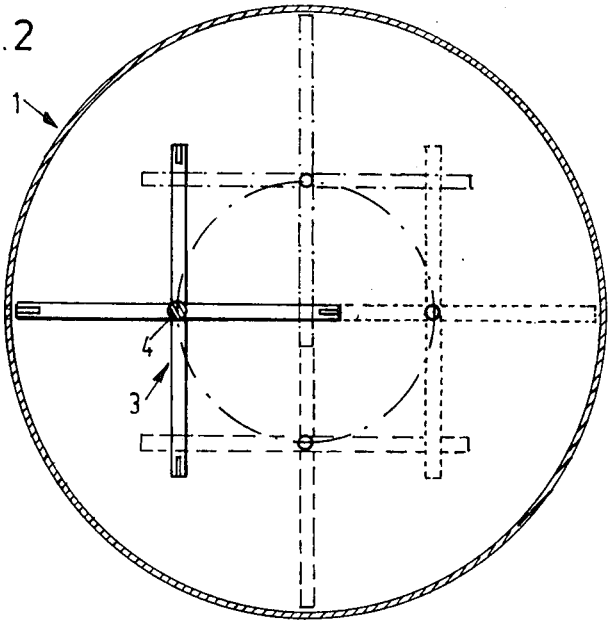
FIG. 2 is a schematic sectional view of the vessel shown in FIG. 1.

FIG. 2 shows schematically the successive positions of the agitator system in the vessel. It appears therefrom that, since the agitator shaft 4 performs a conical movement, all parts of the vessel are covered by the agitator blades.

Figure 4:
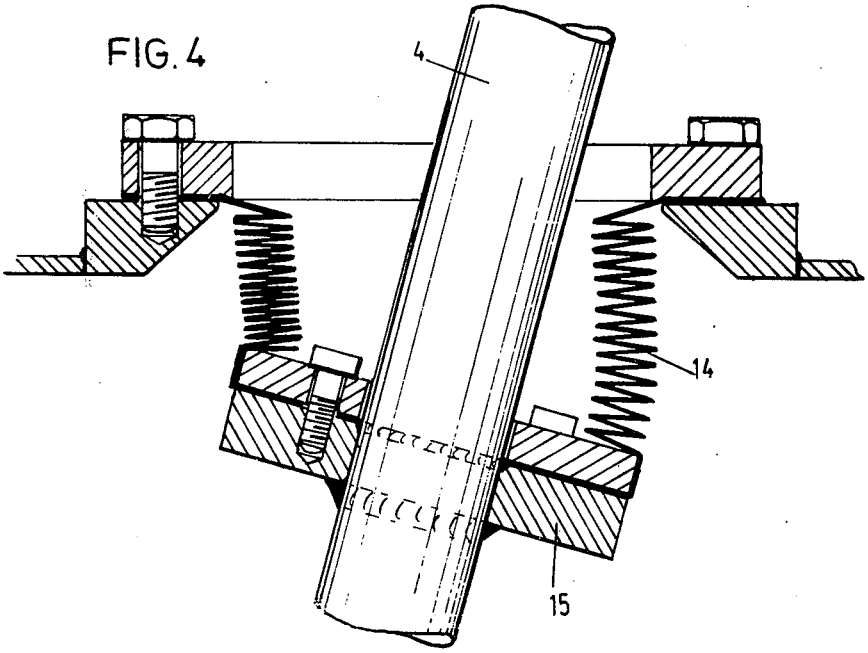
FIG. 4 shows a second embodiment of a sealing member.

FIG. 4 shows a further embodiment of the sealing member formed in this case by a bellows 14, which is fastened by a flange 15 to the agitator shaft 4.

The agitator shaft 4 may, alternatively, be driven with the aid of a rotating arm, arranged by one end on the motor shaft. The agitator shaft 4 is rotatably journalled in the other end. During the mixing operation the agitator member is exposed to forces tending to rotate the same. With this driving system the sealing member has to resist torsional forces to such an extent that rotation of the agitator shaft is prevented.

Figure 5:
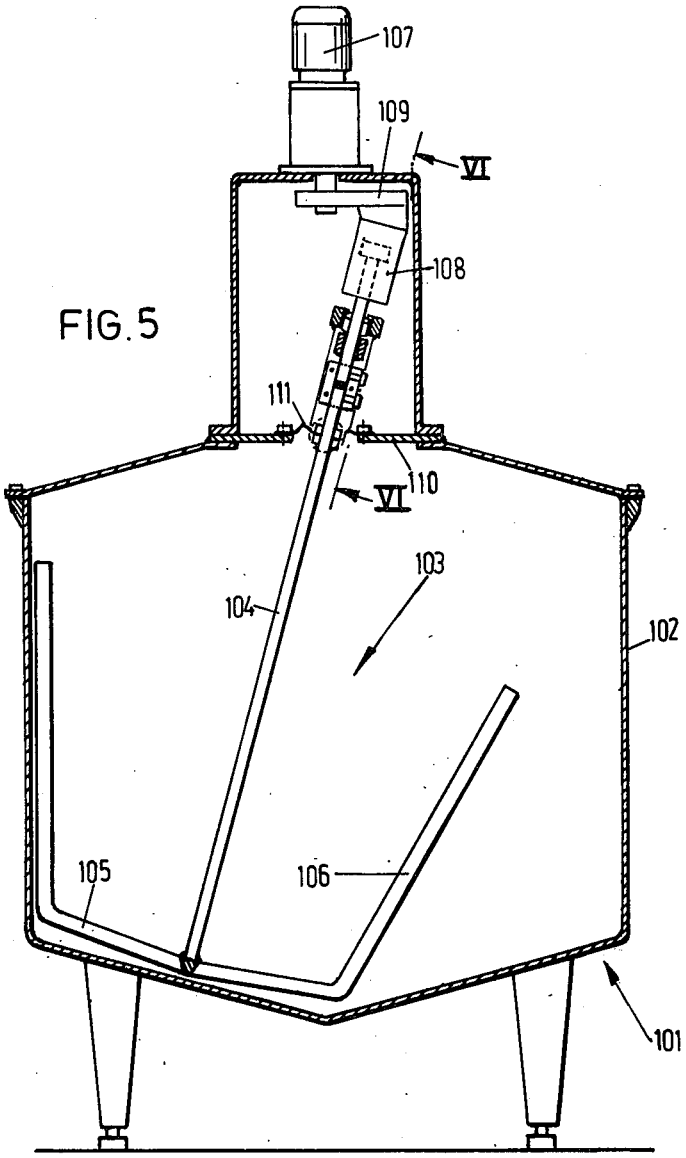
FIG. 5 is a sectional view of a variant of a mixing device embodying the invention.

FIG. 5 shows a mixing device 100 comprising a vessel 102 and an agitator member 103 extending inside the vessel and formed by an agitator shaft 104 and radially extending agitator blades 105 and 106. At the top end the agitator shaft is freely rotatably journalled eccentrically to the centre line of the vessel in a sleeve 108. The sleeve 108 is connected to a point of the circumferential part of a disc 109, which is rotatably driven with the aid of an electric motor 107. The mixing space in the vessel 102 is sealed from the driving part by an annular disc 110, at the centre of which an opening is provided for the agitator shaft 104. By means of a diaphragm 111 the agitator shaft is hermetically sealed from the annular disc 110.

Figure 6:
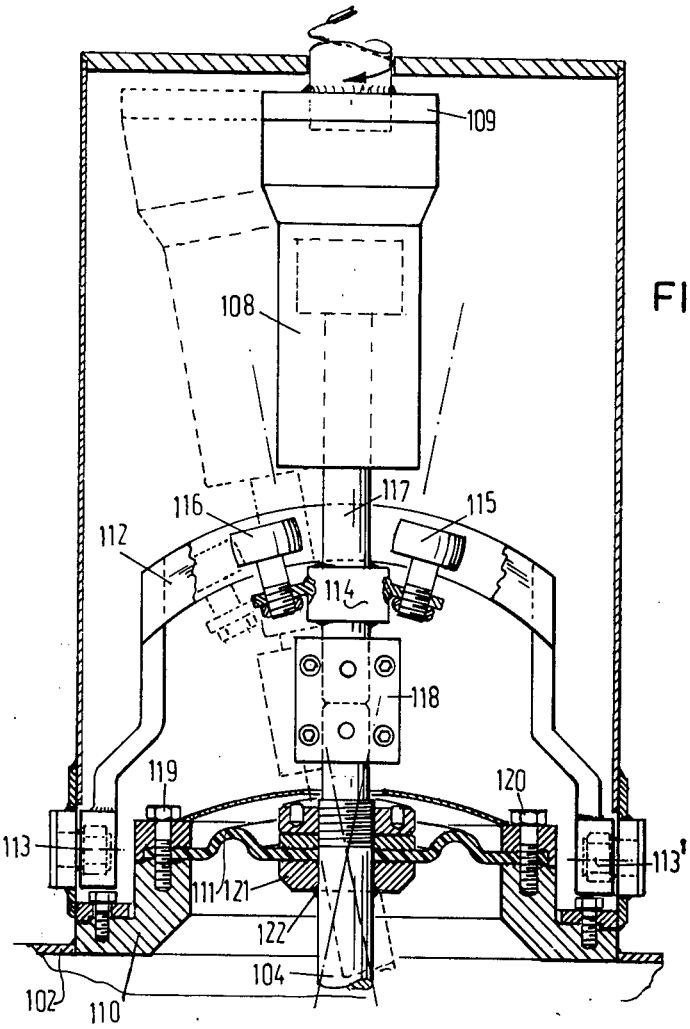
FIG. 6 is a sectional view taken on the line 2—2 in FIG. 5.

From FIG. 6 it will be apparent that the means for maintaining a constant angular position of the agitator shaft 104 are formed by a guide path 112 in the shape of a bracket, which is adapted to pivot around horizontal shafts 113 and 113', journalled in the wall of the driving part. The guide path allows a translatory movement of the agitator shaft 104 in one direction, whilst owing to the pivotable arrangement of the guide path 112 about the shafts 113 and 113' the agitator shaft 104 is allowed to move in a direction at right angles to the former direction. FIG. 6 shows the agitator shaft in two positions, one indicated by solid lines and the other by broken lines. In the embodiment shown in FIG. 6 the agitator shaft is secured against rotation because it is rigidly connected by means of the connecting member 114 with the freely rotatable guide rollers 115 and 116, which co-operate with the guide path 112. The guide path 112 is formed by a bracket having a slot in which the guide rollers 115 and 116 are adapted to roll. The driving shaft 107, coupled with the sleeve 108, is connected by means of the coupling member 118 with the agitator shaft 104. The coupling member 118 permits of arranging the point of intersection of the agitator shaft 104 and the diaphragm 111 so that it coincides with the point of intersection of the rotary axes of the guide rollers 115 and 116. The diaphragm 111 may be connected by bolts 119 and 120 with the annular disc 110 and is sealed by means of the connecting member 121 by welds 122 on the agitator shaft 104.

The horizontal pivotal shaft 113 preferably extends along the centre line of the vessel. Instead of using the guide rollers 115 and 116, the agitator shaft 104 may be secured against rotation by shaping it with a flattened part or flattened parts, for example, in a square form, the shaft being thus enclosed non-rotatably in the slot of the guide paths 112.

Figure 7:
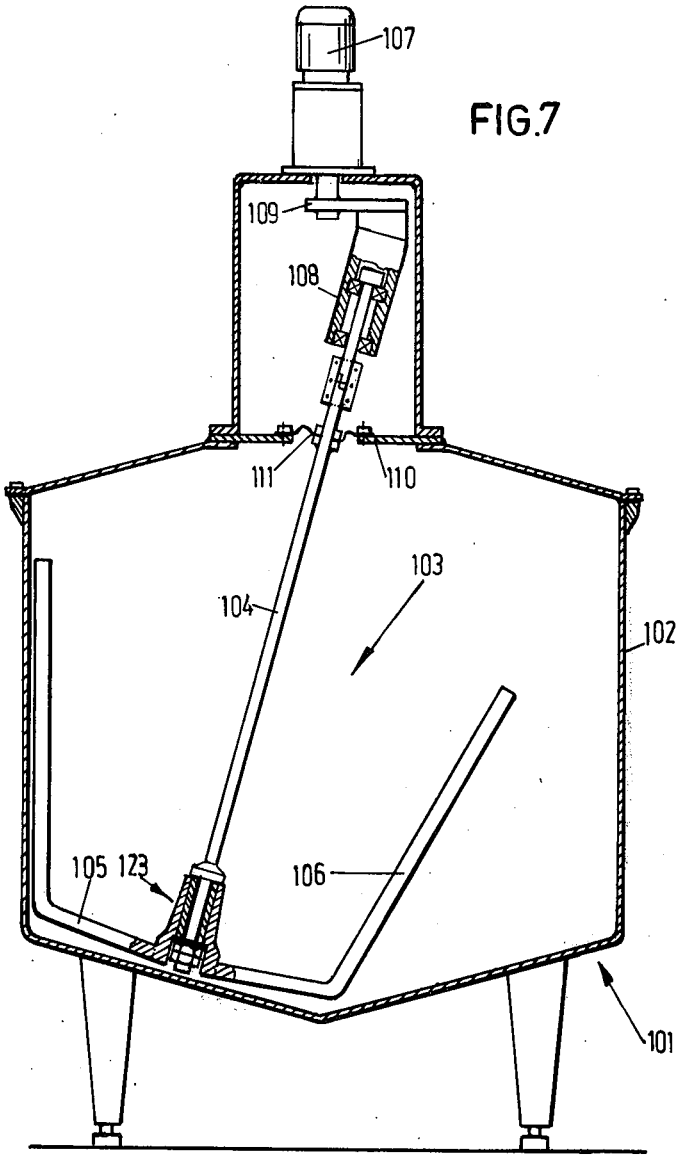
FIG. 7 is a sectional view of a third embodiment of the invention.

In the embodiment shown in FIG. 7 the agitator blades 105 and 106 are freely rotatable with respect to the agitator shaft 104 with the interposition of the bearing 123. It is thus avoided that the torque exerted during the movement across the fluid on the agitator blades should be transferred to the agitator shaft 104.

What we claimed is:

1. A mixing device comprising, in combination:

a vessel having a bottom, a side wall defining a vessel axis and a top, all defining a closed space of circular cross section for receiving material to be mixed, said top having a central opening therein;

a mixing shaft projecting through said opening into said closed space at an inclination to said vessel axis to present an inner end within said vessel reaching to adjacent said bottom and an outer end outside said vessel;

flexible sealing means joining a section of said shaft between its ends to said cover whereby hermetically to isolate said space and establish a pivot substantially on said vessel axis;

blade means on the inner end of said shaft and including portions radially offset therefrom; and drive means connected to said outer end of the shaft for orbiting said outer end without causing rotation of said shaft whereby said inner end of the shaft sweeps a conical path within said vessel, said portions of the blade means being radially offset from said conical path sufficiently to reach into close proximity with said side wall of the vessel, said drive means comprising a drive shaft aligned with said vessel axis, an arm fixed to said drive shaft and bearing means rotatably connecting said outer end of the mixer shaft to said arm in offset relation to said drive shaft, said blade means being fixed to said inner end of the mixer shaft and including means engaging said outer end of the mixer shaft preventing rotation thereof, the means last mentioned comprising a bracket pivoted about an axis normal to said vessel axis and having a slot extending in the direction of the bracket axis, said outer end of the mixer shaft being non-rotatably guided in said slot.

* * * * *

UNITED STATES PATENT AND TRADEMARK OFFICE

CERTIFICATE OF CORRECTION

PATENT NO. : 4,057,226

DATED : November 8, 1977

INVENTOR(S) : Jacob Mink de Mos and Pieter Koek

It is certified that error appears in the above-identified patent and that said Letters Patent are hereby corrected as shown below:

[30] Foreign application priority data

Add: December 6, 1973 Netherlands.....73.16753

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*